United States Patent [19]

Kobayashi et al.

[11] Patent Number: 4,862,848

[45] Date of Patent: Sep. 5, 1989

[54] APPARATUS FOR SUPPLYING START-FUEL IN THE INTERNAL COMBUSTION ENGINE FOR A PORTABLE TYPE WORKING MACHINE

[75] Inventors: Takeshi Kobayashi, Yokohama; Kohji Nagasaka, Kawasaki; Yoshimi Sejimo, Urayasu, all of Japan

[73] Assignee: Walbro Far East, Inc., Kawasaki, Japan

[21] Appl. No.: 237,964

[22] Filed: Aug. 29, 1988

[30] Foreign Application Priority Data

Sep. 7, 1987 [JP] Japan ..... 62-223757

[51] Int. Cl.[4] ..... F02M 1/08

[52] U.S. Cl. ..... 123/187.5 R; 123/180 P; 261/DIG. 8

[58] Field of Search ..... 123/187.5 R, 180 E, 123/180 P; 261/DIG. 8

[56] References Cited

U.S. PATENT DOCUMENTS

| | | | |
|---|---|---|---|
| 3,371,658 | 3/1968 | Turner | 123/187.5 R |
| 4,373,479 | 2/1983 | Billingsley et al. | 123/187.5 R |
| 4,508,068 | 4/1985 | Tuggle et al. | 123/187.5 R |
| 4,676,204 | 6/1987 | Iroguchi et al. | 123/180 P |

FOREIGN PATENT DOCUMENTS

| | | | |
|---|---|---|---|
| 59-54758 | 3/1984 | Japan | 123/187.5 R |

*Primary Examiner*—Andrew M. Dolinar

*Attorney, Agent, or Firm*—Barnes, Kisselle, Raisch, Choate, Whittemore & Hulbert

[57] ABSTRACT

An apparatus for supplying a start-fuel to an internal combustion engine for a portable type machine such as a chain saw or brush cutter which has an electric battery for use in starting. An electrically driven reversible pump is used to draw fuel from a diaphragm carburetor metering chamber into a fuel reservoir and also to draw fuel from a fuel tank into the metering chamber. Under cold-start conditions, the pump is reversed and fuel from the reservoir is directed to a jet at the entrance of the carburetor venturi passage to provide a rich mixture to assist in starting.

4 Claims, 4 Drawing Sheets

APPARATUS FOR SUPPLYING START-FUEL IN THE INTERNAL COMBUSTION ENGINE FOR A PORTABLE TYPE WORKING MACHINE

REFERENCE TO RELATED APPLICATION

Reference is made to the following simultaneously filed United States application which is assigned to an assignee common to the present application:

Ser. No. 238,286-Filed Aug. 29, 1989 pending

FIELD OF INVENTION

The present invention relates to an apparatus for supplying start-fuel in an internal combustion engine for a portable type working machine.

BACKGROUND AND FEATURES OF THE INVENTION

A small two-cycle internal combustion engine used as a driving source for portable working machines such as a chain saw, a brush cutter and the like is equipped with a diaphragm type carburetor so that excellent operation of the internal combustion engine may be controlled in any attitude.

As disclosed in Japanese patent application Laid-Open Publication No. 35047/1987, there is proposed an arrangement wherein when the engine is started, fuel is supplied from a fuel tank to a metering chamber by a manual primer pump, the fuel being also present in an accumulator chamber, and a button of an accumulator is operated simultaneously with the starting rotation operation (cranking) of the engine to supply the fuel in the accumulator from a fuel nozzle to an air intake passage of a carburetor. However, recently, the internal combustion engine equipped with a battery operated motor has been mounted on the aforementioned portable working machine. It is desirable that a power supply for driving the motor is utilized to automatically perform a series of operations.

It is an object of the present invention to provide an apparatus for supplying start-fuel in the internal combustion engine for a portable type working machine in which replenishment of fuel to a metering chamber and supplying of start-fuel to a fuel nozzle are automatically effected by normal and reverse rotations of a primer pump driven by an electric motor.

BRIEF DESCRIPTION OF THE INVENTION

For achieving the aforesaid object, the present invention provides an arrangement wherein a volume type primer pump driven by an electric motor is provided between a metering chamber of a diaphragm type carburetor and a fuel tank; a check valve for allowing a flow to a volume variable type fuel reservoir and a fuel tank is connected between the primer pump and the fuel tank, and a check valve for allowing a flow to the primer pump is connected between the metering chamber and the primer pump.

DETAILED DESCRIPTION OF THE INVENTION AND THE MANNER AND PROCESS OF USING IT

Figure 1:
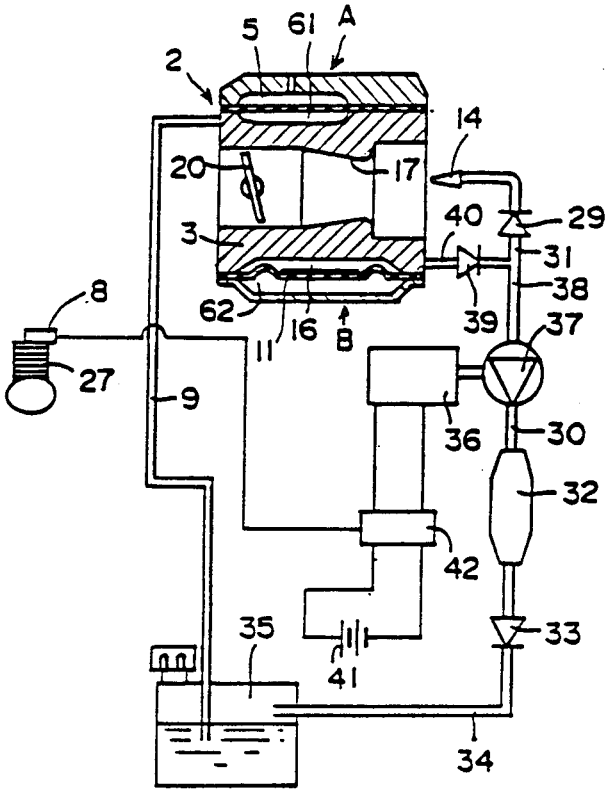
FIG. 1 is an entire structural view of an apparatus for supplying start-fuel in the internal combustion engine for a portable working machine according to the present invention.

When a primer pump 37 is normally rotated prior to starting of the engine, fuel in a metering chamber 16 of a fuel supply mechanism B is drawn into the primer pump 37 via a passage 40, a check valve 39 and a passage 38, an thence discharged into a fuel tank 35 via a passage 30, a fuel reservoir 32, a check valve 33 and a pipe 34. Accordingly, the metering chamber 16 assumes a negative pressure state, and fuel in the fuel tank 35 is supplied to the metering chamber 16 via a pipe 9, a pump chamber 61 of a fuel pump A, a passage 60 and an inlet valve 10.

Subsequently, when the primer pump 37 is reversely rotated simultaneously with cranking the engine 27 caused by an electric motor, fuel in the fuel reservoir 32 is drawn into the primer pump 37 via the passage 30, and thence injected into an air intake passage 17 from a fuel nozzle 14 via the passage 38, a passage 31 and a check valve 29. In this manner, a rich mixture is created in the carburetor 2 at the time of start and is sent to the engine 27. Thus, the engine is positively started.

Under conditions where the ambient temperature is suitable for starting the engine 27, a thermo-switch or temperature switch 8 is functioned so that the primer pump 37 is not reversely rotated.

Figure 2:
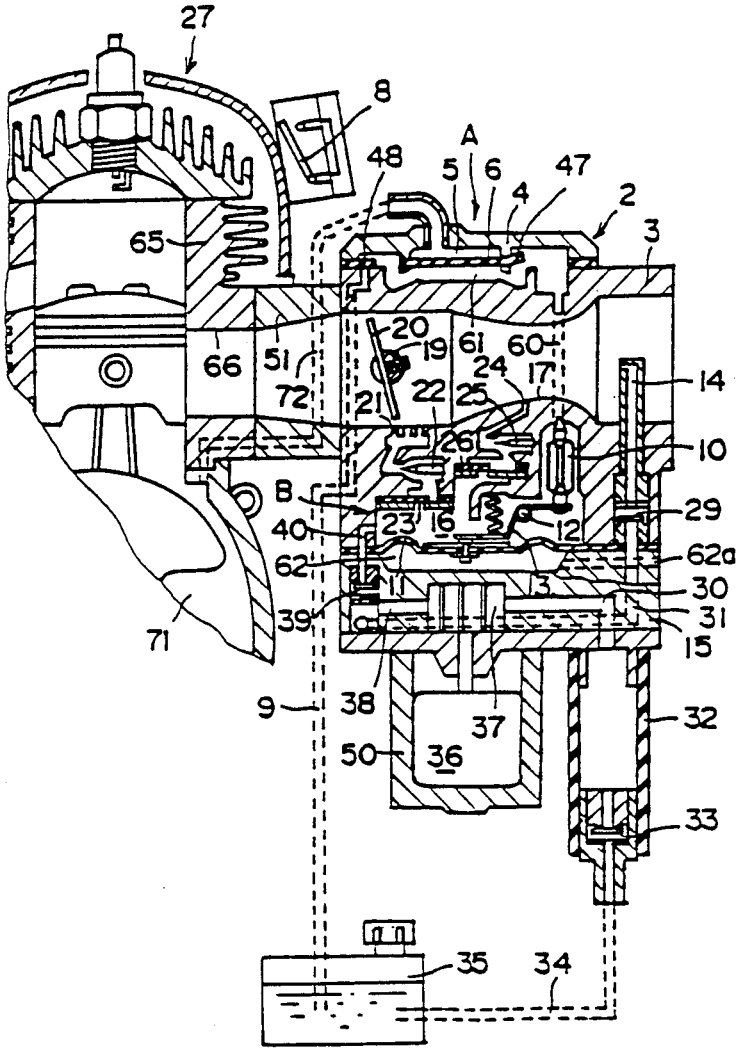
FIG. 2 is a sectional side view showing the detailed construction of the apparatus.

FIG. 1 shows a schematic structure of an apparatus for supplying start-fuel to the internal combustion engine according to the present invention. The apparatus comprises a volume type primer pump 37 such as a gear pump or a vane pump, normally and reversely rotated by a motor 36, a fuel reservoir 32 disposed between the primer pump 37 and a fuel tank 35, and a fuel nozzle 14 disposed in an air intake passage 17 of a carburetor 2. Upon energization by a battery 41 through a control device 42, the motor 36 is normally or reversely rotated. In the case where injection of the starting fuel from the fuel nozzle 14 is not needed, the reverse rotation of the motor 36 is impeded by a signal from a temperature switch 8 disposed on the external portion of the engine 27 (FIG. 2).

The carburetor 2 is provided at the upper portion with a fuel pump A in which a pulsating pressure is introduced into chamber 5, which together with a pump chamber 61, are defined by a diaphragm 6. At the lower portion of the carburetor, a fuel supply mechanism B is provided in which a metering chamber 16 and an atmospheric chamber 62 are defined by a diaphragm 11. In the normal operation of the engine, fuel in the fuel tank 35 is drawn into the fuel pump A via a pipe 9 and then sent to the metering chamber 16 and fuel in the metering chamber 16 is drawn into the air intake passage 17 via a fuel jet 24 by the intake negative pressure of the air intake passage 17.

When the primer pump 37 is normally rotated to supply fuel to the metering chamber 16, prior to starting the engine, the fuel in the metering chamber 16 is drawn into the primer pump 37 via the passage 40, a check valve 39 and a passage 38, and thence into the passage 30 and the fuel reservoir 32. Surplus fuel is returned to the fuel tank 35 via the check valve 33 and the pipe 34. In this manner, when the metering chamber 16 assumes a negative pressure state, fuel in the fuel tank 35 passes through the pipe 9 and is supplied to the metering chamber 16 via the pump chamber 61 of the fuel pump A and a passage 60 (FIG. 2).

When the primer pump 37 is reversely rotated simultaneously with cranking to start the engine, fuel in the reservoir 32 is drawn into the primer pump 37 via the passage 30 and thence injected as a starting fuel from the fuel nozzle 14 to the air intake passage 17 via the passage 38, the passage 31 and the check valve 29.

Figure 3:
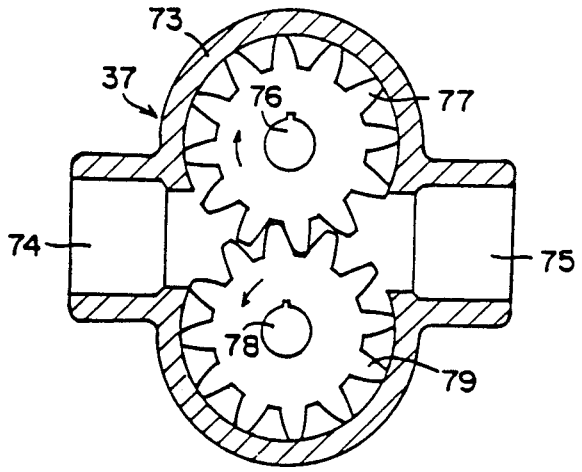
FIG. 3 is a sectional plan view showing one example of a primer pump.

As shown in FIG. 3, a gear pump, for example, as the primer pump 37, has a casing 73 which accommodates therein gears 77 and 79 supported on shafts 76 and 78, respectively, and engaged with each other, and, if one of the shafts 76 and 78 is normally rotated (in a direction indicated by arrow) by a motor 36 (FIG. 1), fuel is drawn through the opening 74 and discharged out of an opening 75 passing the outside of the gears 77 and 79.

Figure 4:
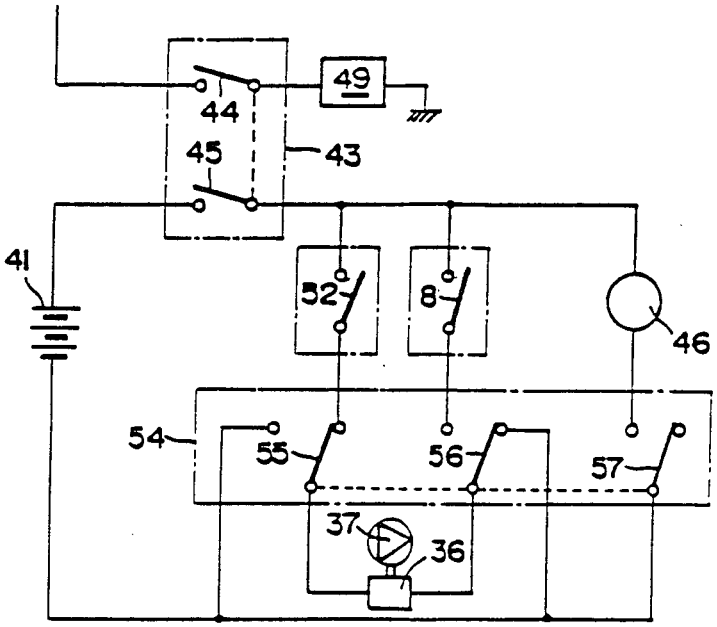
FIG. 4 is a circuit view of a control device for the apparatus.

FIG. 4 shows the detailed construction of a control device 42. A switch 44 for driving an ignition circuit 49 of the engine and a switch 45 operatively connected thereto are operated by a start key as a key switch 43. A fixed contact of the switch 45 is connected to a positive terminal of a battery 41 whereas a movable contact thereof is connected to fixed contact of a pump switch 52 and a temperature switch 8 and one terminal of a battery operated motor 46.

The movable contact of the pump switch 52 is connected to one fixed contact of a change-over switch 55, and the movable contact of the temperature switch 8 is connected to one fixed contact of a change-over switch 56. The motor 36 is connected between the movable contacts of the change-over switches 55 and 56. The other fixed contacts of the change-over switch 55 ad 56 are connected to a negative terminal of the battery 41. The other terminal of the battery operated motor 46 is connected to a negative terminal of the battery 41 via a switch 57.

When the key switch 43 is closed and the pump switch 52 is closed, prior to starting the engine (prior to rotation of the engine), an energizing circuit is formed from the battery 41 to the switch 45, the pump switch 52, the change-over switch 55, the motor 36, the change-over switch 56 and the battery 41, whereby the motor 36 is normally rotated. Then, as described above, the fuel in the metering chamber 16 is drawn by the primer pump 37 into the fuel reservoir 32 and fuel in the fuel tank 35 is supplied to the metering chamber 16 via pipe 9, pump chamber 61 of fuel pump A, a passage 60, and an inlet valve 10.

Subsequently, when a start switch 54 is switched, an energizing circuit is formed from the battery 41 to the switch 45, the motor 46, the switch 57 and the battery 41, whereby the motor 46 is driven. In the state where the ambient temperature of the engine is a temperature at which starting is difficult (at cold season), the temperature switch 8 remains closed, and, therefore, an energizing circuit comprising the battery 41, the switch 45, the temperature switch 8, the change-over switch 56, the motor 36, the change-over switch 55 and the battery 41 is formed whereby the motor 36 is reversely rotated. Thereby, fuel in the fuel reservoir 32 is injected from the fuel nozzle 14 to the air intake passage 17 of the carburetor 2. In this way, the engine is started, and when the start switch 54 is returned to the illustrated state, the motor 36 and the motor 46 stop.

FIG. 2 shows the mounting state of the carburetor 2 integrally provided with the primer pump 37, the fuel reservoir 32 and the fuel nozzle 14 leading to the engine 27. To the engine 27 is mounted the diaphragm type carburetor 2 and an air cleaner (not shown) through an intake pipe 51 formed of a heat insulating material on the side wall of a cylinder 65. A pipe 9 from the fuel tank 35 is connected to an inlet side of the fuel pump A of the carburetor 2.

In the carburetor 2, the air intake passage 17 including a venturi of the body 3 is communicated with an intake port 66 provided in a cylinder 65. Interiorly of the air intake passage 17 a well-known throttle valve 20 is rotatably supported by a valve shaft 19.

A cover 4 is coupled to the upper wall of the body 3 with a diaphragm 6 disposed therebetween, and a cover 15 is coupled to the lower wall with diaphragm 11 disposed therebetween. The cover 4 is provided with a pulsating pressure introducing chamber 5, which is connected to a crank chamber 71 of the engine 27 through a pipe 72. A pump chamber 61 defined by the diaphragm 6 is connected to a pipe 9 via check valve 48. The pump chamber 61 is connected to the metering chamber 16 via check valve 47, a passage 60 and an inlet valve 10.

An atmospheric chamber 62 between a diaphragm 11 defining the metering chamber 16 and a cover 15 is opened to the atmosphere by a passage 62a. The inlet valve 10 in the form of a needle valve is disposed on the end of the passage 60 and is opened and closed by a lever 13 supported on the wall of the metering chamber 16 by a shaft 12. One end of the lever 13 is biased into engagement with the end of the inlet valve 10 by means of the force of a spring. The other end of the lever 13 is formed in abutment with a projection coupled to an approximate center of the diaphragm 11. The metering chamber 16 is connected to a high-speed fuel jet 24 via a check valve 26 and a high-speed fuel metering needle valve 25. The metering chamber 16 is connected to a low-speed fuel jet 21 via a check valve 23 and a low-speed fuel metering needle valve 22.

To the cover 15 is coupled a housing 50 on the underside of the cover 15 which accommodates a motor 36 coupling the shaft of the primer pump 37. The primer pump 37 is accommodated within the housing integral with the cover 15.

One opening (an inlet at the time of normal rotation) of the primer pump 37 is connected to the metering chamber 16 via a passage 38, a check valve 39 and a passage 40. The other opening (an outlet at the time of normal rotation) of the primer pump 37 is connected to a full reservoir 32 formed of a flexible tube connected to the housing 50 via a passage 30. The fuel reservoir 32 is connected to a fuel tank 35 via a check valve 33 coupled to the lower end thereof and a pipe 34.

The fuel reservoir 32, provided between the primer pump 37 and the fuel tank 35, is constituted as a pipe formed of a resilient material such as rubber or vinyl, by which volume (length) a quantity of start-fuel to be supplied to the engine can be easily varied. When the primer pump 37 is reversely rotated and fuel in the fuel reservoir 32 begins to be drawn into the primer pump 37, the check valve 33 is closed to prevent a backflow of fuel from the fuel tank 35. At this time, the fuel reservoir 32 is collapsed by pumping action of the primer pump 37 and action of the external atmosphere. If the fuel in the fuel reservoir 32 is consumed, even if the primer pump 37 is actuated, no fuel is supplied to the fuel nozzle 14. The quantity of start-fuel to be supplied to the fuel nozzle 14 corresponds to the volume of elastically defined portion of the fuel reservoir 32. For the fuel reservoir 32, a vinyl pipe or the like for connecting the passage 30 communicated with one opening of the primer pump 37 with the fuel tank 35 can be used without modification. In this case the check valve 33 is disposed in the midst of the vinyl pipe.

One opening of the primer pump 37 is connected to the fuel nozzle 14 via a passage 38, a passage 31 and a check valve 29 disposed interiorly of the body 3. The fuel nozzle 14 is disposed in an approximate center of the inlet side of the air intake passage 17, a jet opening of which is directed toward the downstream of the air intake passage 17.

IN THE OPERATION

As described above, according to the present invention a volume type primer pump driven by a motor is provided between a metering chamber of a diaphragm type carburetor and a fuel tank, a check valve for allowing a flow to a volume variable type fuel reservoir and the fuel tank is connected between the primer pump and the fuel tank, and a check valve for allowing a flow to the primer pump is connected between the metering chamber and the primer pump. Therefore, when the primer pump is normally rotated by a motor prior to the starting of the engine, fuel in the metering chamber is moved into the fuel reservoir 32 and fuel from the fuel tank is replenished into the metering chamber 16. Accordingly, even if fuel in the metering chamber is vaporized by heat immediately after the engine has been stopped and extremely reduced in quantity, fuel is replenished before starting, and therefore the defective starting of the engine can be avoided.

Under conditions of a cold-start, the primer pump is reversely rotated simultaneously with the cranking of the engine and fuel in the fuel reservoir is injected from the fuel nozzle to the air intake passage of the carburetor. Therefore, the injected fuel is efficiently atomized, and the mixture necessary for and sufficient for starting is supplied to the engine, thus providing the positive start of the engine and maintaining the operation after start.

What is claimed is:

1. An apparatus for supplying start-fuel to an internal combustion engine for a portable type working machine characterized in that a volume type primer pump driven by a motor is provided between a metering chamber of a diaphragm type carburetor and a fuel tank, a check valve for allowing a flow to volume variable type fuel reservoir and a fuel tank is connected between the primer pump and the fuel tank, and a check valve for allowing a flow to the primer pump is connected between the metering chamber and the primer pump.

2. An apparatus for supplying start-fuel in the internal combustion engine for a portable type working machine according to claim 1, wherein a check valve for allowing a flow to a fuel nozzle is connected between the primer pump and the fuel nozzle disposed in an air intake passage of the carburetor.

3. An apparatus for supplying start-fuel in the internal combustion engine for a portable type working machine according to claim 2, wherein when the primer pump is independently normally rotated, the fuel in the metering chamber is drawn into the fuel tank via the fuel reservoir, and when the primer pump is operatively connected to a motor, the primer pump is reversely rotated to inject the fuel in the fuel reservoir to the fuel nozzle.

4. An apparatus for supplying start fuel to an internal combustion engine for a portable type working machine in which a diaphragm carburetor has an air-fuel mixing passage with an air inlet, a metering chamber with conventional main and idle ports, a fuel supply tank, and a fuel pump to move fuel from said tank to said metering chamber, characterized in a supplemental fuel nozzle directed to said air inlet, a variable volume fuel reservoir in a conduit between said fuel nozzle and said fuel tank, a reversible power driven primer pump associated with said conduit between said nozzle and said reservoir, and a one-way connection between said metering chamber and said conduit, wherein rotation of said pump in one direction moves fuel from said metering chamber to said reservoir and rotation of said pump in a reverse direction with the cranking of the engine, moves fuel directly from said reservoir to said fuel nozzle.

* * * * *